US005363607A

United States Patent [19]

Turturro

[11] Patent Number: 5,363,607

[45] Date of Patent: Nov. 15, 1994

[54] FLAGPOLE AND CAP

[76] Inventor: Nicholas A. Turturro, 7 Mohegan Trail, Saddle River, N.J. 07458

[21] Appl. No.: 186,575

[22] Filed: Jan. 26, 1994

[51] Int. Cl.[5] ..... E04H 12/00

[52] U.S. Cl. ..... 52/40; 52/114; 116/173; 248/533

[58] Field of Search ..... 52/40, 726.3, 118, 114, 52/121; 116/173; 248/530, 533, 529

[56] References Cited

U.S. PATENT DOCUMENTS

| | | | |
|---|---|---|---|
| 3,182,936 | 5/1965 | Murdock | 248/530 |
| 3,286,682 | 11/1966 | Cook et al. | 116/173 |
| 3,421,473 | 1/1969 | Weichenrieder | 116/173 X |
| 3,752,975 | 8/1973 | Meyer | 116/173 X |
| 3,843,079 | 10/1974 | Reisling | 248/530 |
| 3,952,695 | 4/1976 | Vollstedt . | |
| 4,513,938 | 4/1985 | Seymour | 52/40 X |
| 4,800,834 | 1/1989 | Feng . | |
| 4,949,525 | 8/1990 | Weaver | 52/726.3 X |
| 4,953,905 | 9/1990 | Cohen . | |
| 5,218,375 | 6/1993 | Hillman | 52/118 X |

FOREIGN PATENT DOCUMENTS

| | | | |
|---|---|---|---|
| 920208 | 11/1954 | Germany | 52/40 |

*Primary Examiner*—Lanna Mai

*Attorney, Agent, or Firm*—Terrance L. Siemens

[57] ABSTRACT

An improved flagpole construction is disclosed. The device includes a cap that passes the halyard through two apertures to obviate the need for a pulley or like apparatus. The device is lightweight, strong, and is easy to assemble. A plurality of hollow PVC tubing lengths make up the pole portion of the device. These have decreasing inner diameters, the diameters decreasing in amounts proximate the thickness of the tubing walls such that they fit telescopically within one another and they are connected by pipe reducing fittings, also preferably constructed of PVC material, to provide for a weather tight fit. The telescopic construction provides for strength as up to half of the length of each of the tubing lengths is nested within the one preceding it. The various tube lengths are secured to each other by bores extending through the various telescoped pairs, with a bolt or like object fastened therein. The cap portion of the invention has a removable top to allow for the replacement of the halyard as it becomes worn, A rope cleat is secured to the lower length of the device as a halyard securement.

10 Claims, 1 Drawing Sheet

FLAGPOLE AND CAP

BACKGROUND OF THE INVENTION

1. Field of the Invention

The present invention relates to display devices. More specifically, it relates to flag or banner poles. Even more specifically, it relates to a flag or banner pole having no moving parts and that is almost entirely constructed of standard PVC tube material. The tubes are telescopically arranged and bolted in place, with a substantial portion of each successive tube being maintained within the preceding tube to provide added overall strength. The tubes are connected at joints that are made up of standard PVC pipe reducing fittings.

2. Description of the Prior Art

It is common all over the world to display ceremonial or patriotic banners or flags at various times, on special occasions, and, in many cases, on a daily basis. One of the most common of these display devices is the flagpole. These allow the banner or flag to be seen at appreciably longer distances as a function of the elevation of the flag above the ground. Most flagpoles are permanent affairs, generally made of metal and, as such, are subject to rust and other vagaries that constant exposure to climactic conditions engender in the construction material. Another drawback to conventional flag poles is the fixed nature of their installation. Most are set in the ground in a concrete base, and are thus difficult or almost impossible to move or take down. Additionally, the metal material from which they are made is extremely heavy, making the installation of one of the devices work for a specialized person or persons using heavy equipment. The present invention seeks to address these problems by providing an inexpensive, lightweight flagpole construction that can be installed either permanently or temporarily in a location, and that has no moving parts to become rusted or tangled. During a search in this art, the following patents were uncovered:

In U.S. Pat. No. 4,953,905 issued on Sep. 4, 1990 to Abraham Cohen there is disclosed a telescoping display device where a plurality of telescoping elongate conical segments are nested within one another and housed in a fluid tight container. When a fluid, such as air, is introduced into the container, the segments are sequentially disposed outward, with the base of each engaging the end of the next.

Next in this discussion is U.S. Pat. No. 3,952,695 issued on Apr. 27, 1976 to Otto A. Vollstedt wherein a slotted tubular flagpole is disclosed. The slot extends substantially along the entire length of the pole and allows for a follower structure to extend therethrough. Within the pole are a pair of aligned pulleys and an endless tensioned member that carries the follower structure thereon.

Another patent of interest is U.S. Pat. No. 4,800,834 issued on Jan. 31, 1989 to Ou-Yang Feng. This discloses a telescopic rod with a rolling display sheet. The device has a pipe-handle with a longitudinal slit therein. An alignment coupler with a corresponding longitudinal protrusion travels along the slit and retains a reel pole with a display sheet.

Lastly, U.S. Pat. No. 4,949,525 issued on Aug. 21, 1990 to John H. Weaver discloses a rotatable, flexible flagpole arrangement. In this device a pole, which is described as being constructed of PVC type material, is rotatably mounted on a support surface. The contact point between the two is a sliding pair of embossed washers.

None of the above inventions and patents, taken either singly or in combination, is seen to describe the instant invention as claimed.

SUMMARY OF THE INVENTION

The present invention is an improved flagpole construction including a cap that has no moving parts, is lightweight, strong, and is easy to assemble. The pole portion of the device is made up of a plurality of hollow PVC tubing lengths having decreasing inner diameters, the diameters decreasing in amounts proximate the thickness of the tubing walls such that they fit telescopically within one another. the tubing sections are connected by standard pipe reducing fittings, also preferably constructed of PVC material, to provide for a weather tight fit. The telescopic construction provides for strength and flexibility. The various tube lengths are secured to each other by bores extending through the various telescoped pairs, with a bolt or like object fastened therein. The cap portion of the invention has a removable top and a pair of apertures in its floor to allow the halyard to pass. Thus, no pulleys or the like are necessary for the raising or lowering of the flag or banner. A rope cleat is secured to the lower length of the device as a halyard securement.

Accordingly, it is a principle object of the invention to provide an improved flagpole construction that allows for easy construction of the device without resorting to special tools or heavy equipment.

It is another object of the invention to provide an improved flagpole construction wherein the pole portion of the unit is made up of a plurality of telescopically arranged PVC tubes secured by lateral bores through the adjacent tube pairs to admit securing bolts.

It is a further object of the invention to provide an improved flagpole construction wherein the telescopic arrangement of subsequent tube lengths is such that a substantial portion of the succeeding smaller tube extends within the preceding, larger diameter tube to increase the overall structural strength.

Still another object of the invention is to provide an improved flagpole construction wherein the tube lengths are sealed one to the other by pipe reducing fittings to allow for a weather tight seal.

Still yet a further object of the invention is to provide a flagpole construction that includes a cap with a removable top and a base that has a pair of apertures proximate one another to pass the halyard, obviating the need for a pulley apparatus or the like.

It is a major goal of the invention to provide improved elements and arrangements thereof in an apparatus for the purposes described which is inexpensive, dependable and fully effective in accomplishing its intended purposes.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
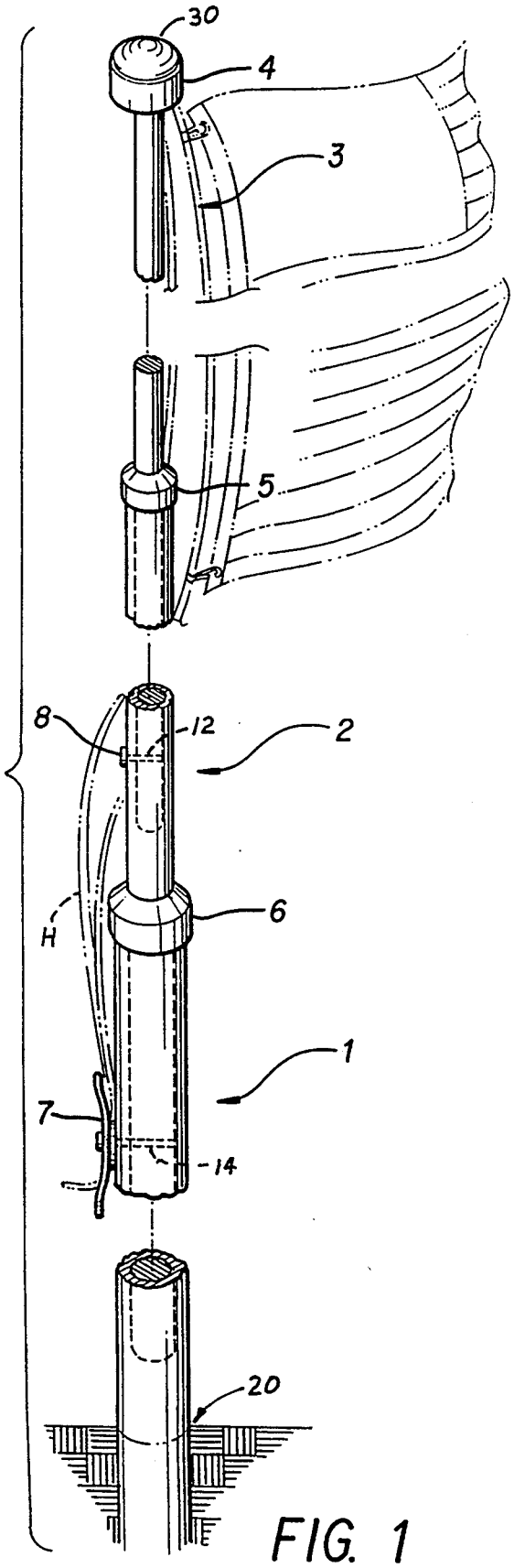
FIG. 1 is an environmental perspective view of the present invention.

The present invention is an improved construction for a flagpole. The pole portion itself will be discussed first. The pole portion is made up of three separate sections of tubing. These sections are designated as 1, 2, and 3 in FIGS. 1 and 2. In the preferred embodiment of the invention, these sections are hollow tubing made of a PVC (polyvinyl chloride) material. This tubing is well known, and is used for a variety of purposes. Another perceived advantage of the use of this material is that it is strong and lightweight, it is relatively inexpensive, and it is commonly available at plumbing supply stores and like places. As can be seen from FIGS. 1 and 2, the three lengths of tubing 1, 2, and 3 have, respectively, decreasing diameters. Preferably, the diameters decrease such that the succeeding pipe fits smoothly within the preceding one; that is, tube 2 fits within tube 1 and tube 3 within tube 2. It also can be seen from the figures that this extension of the successive tubes into the preceding ones is substantial. The lengths of the tubes are such that up to half of the total length is disposed within the preceding tube that makes up the pole. Thus, almost the entire length of the pole has in cross section a double wall type of construction. This gives the overall structure strength to stand up to various weather conditions. The fittings that are attached where the various tubes meet are pipe reducing fittings machined to ensure a water tight seal. These fittings are designated as 5 and 6 in FIGS. 1 and 2 and are also preferably made of PVC material of the kind commonly used in plumbing and other similar endeavors. If the user of the present invention wishes to make the installation permanent, these fittings could be sealed with an adhesive; however, this is not necessary as the fittings themselves have no inherent structural function, being primarily a means to seal out inclement conditions and to provide an aesthetically pleasing line to the pole portion of the device. The pole sections 1, 2, and 3 are held in a fixed relationship with one another by means of self tapping screws 8, 10. Alternatively, bores could be drilled through the tubes as indicated at 12 and 14 and the self tapping screws could be replaced with threaded bolts or any number of other similar art devices. Held on the side of the tube portion 1 by the screw or bolt 10 is a rope cleat 7 to allow for the securing of the halyard when the device is in use. The pole section 1 is inserted a sufficient distance into the ground as indicated at 20 to stabilize the device. This will be discussed further below.

Figure 2:
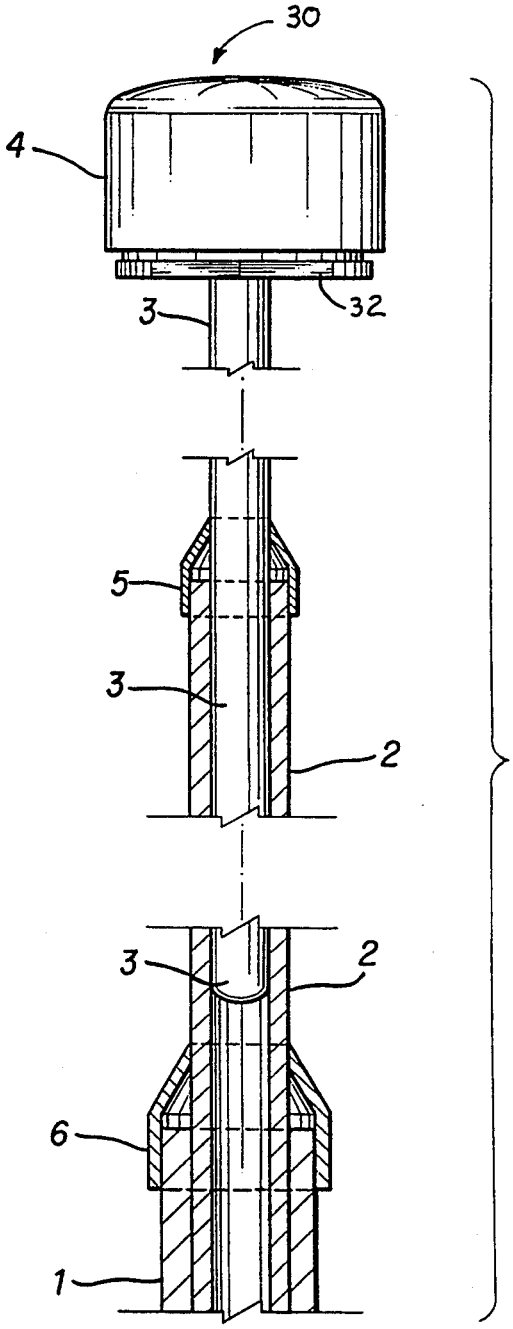
FIG. 2 is a partial cutaway view of the invention, showing clearly the extent to which subsequent, smaller diameter tubes extend into the preceding, larger diameter tube for additional strength.
Figure 3:
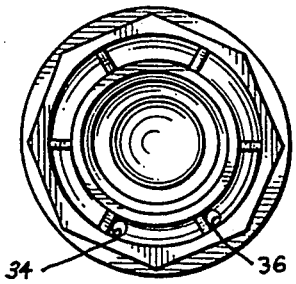
FIG. 3 is a top cutaway view showing details of the construction of the cap, specifically the apertures that pass the halyard.

Referring now to FIGS. 2 and 3, on the top of the pole there is a cap 30. This cap is made up of a base or floor portion 32 and a top 4, preferably friction fit together so as to be removable when desired. Both of these portions 32, 4 are also made of PVC material. There are two apertures 34, 36 in the floor 32 of the cap 30 and these can be seen in FIG. 3. These apertures 34, 36 are both smoothly contoured about their periphery on the interior wall of the base or floor 32. This is to allow for the smooth passage of the halyard H (shown in FIG. 1) through and between them, thus obviating the need for a pulley or like art object.

It is contemplated that the present invention could be sold in a kit form, with the tube portions 1, 2, and 3, being the most bulky parts of the device, being left out, as they are easily available to the purchaser at most plumbing supply stores or hardware outlets and can be cut there to the proper lengths at a minimal cost. Therefore, the only parts of the present invention that need to be shipped are the machined fittings 5, 6, the cap portion 30, the halyard H (including the snap hooks or followers shown clipped to the flag in FIG. 1), the rope cleat 7, and simple instructions for assembly. Thus it can be seen that the present invention provides a low cost alternative to existing flagpoles. The proper lengths of PVC tubing are bought, a hole having the proper diameter is dug with a post hole digger or the like, the tube portions 1, 2, and 3 are secured together with the fittings 5 and 6 properly positioned thereon, and the entire unit is placed in the hole, leveled, and secured. Other construction methods could, of course be used.

It is to be understood that the present invention is not limited to the sole embodiment described above, but encompasses any and all embodiments within the scope of the following claims.

I claim:

1. An improved flagpole comprising:

a pole portion having a base and a top, said pole portion being made up of a plurality of hollow tubular portions, each portion having a length and said portions each having a unique diameter, said tubular portion diameters being sized such that each of said tube portions can slide and telescope within one other;

fixing means for positioning said tubular portions in a predetermined operational relation to one another;

a cap portion located at said top of said pole portion, said cap portion having a pair of halyard apertures for the passage of a halyard rope; whereby said plurality of tubular portions are disposed telescopically in relation to one another, and said fixing means positions said portions in said predetermined operational relation, said base is secured to the ground, and a halyard rope is passed through said halyard apertures in said cap portion such that a flag or banner can be raised or lowered on the pole, thus obviating the necessity for moving parts.

2. The flagpole construction according to claim 1, wherein said fixing means are self tapping screws passing through a pair of said tubular portions to hold said portions in a predetermined relation to one another.

3. The flagpole construction according to claim 1, wherein said pole portion further includes a rope cleat attached to the exterior of one of said tubular portions.

4. The flagpole construction according to claim 1, wherein said cap portion includes a base member and a top member, said base member and said top member being removably engaged to one another, and where said halyard apertures are located in said base member of said cap portion.

5. The flagpole construction according to claim 1, where said predetermined operational configuration defines a position where more than one third of each of said lengths of each of said tube portions is within another of said tube portions.

6. The flagpole construction according to claim 5, wherein said fixing means are self tapping screws passing through a pair of said tubular portions to hold said portions in a predetermined relation to one another.

7. The flagpole construction according to claim 5, wherein said pole portion further includes a rope cleat attached to the exterior of one of said tubular portions.

8. The flagpole construction according to claim 5, wherein said cap portion includes a base member and a top member, said base member and said top member being removably engaged to one another, and where said halyard apertures are located in said base member of said cap portion.

9. The flagpole construction according to claim 1, wherein said pole portion includes a plurality of fittings, and where each of said fittings is located at the meeting point between any two of said tubular portions, said fittings accommodating said diameters of said tubular portions and being flush with the exterior thereof such that a weather tight seal is maintained.

10. The flagpole construction according to claim 1, wherein said tubular portions are made of a PVC material.

* * * * *